US010898769B1

(12) United States Patent
Gonczi et al.

(10) Patent No.: US 10,898,769 B1
(45) Date of Patent: Jan. 26, 2021

(54) GOLF CLUB HEAD CAST FROM GRAPHENE REINFORCED TITANIUM ALLOY

(71) Applicant: Callaway Golf Company, Carlsbad, CA (US)

(72) Inventors: Robert S. Gonczi, Oceanside, CA (US); James A. Seluga, Carlsbad, CA (US); Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/715,885

(22) Filed: Dec. 16, 2019

Related U.S. Application Data

(60) Provisional application No. 62/780,783, filed on Dec. 17, 2018.

(51) Int. Cl.
*A63B 53/04* (2015.01)

(52) U.S. Cl.
CPC ..... *A63B 53/0466* (2013.01); *A63B 53/045* (2020.08); *A63B 2209/00* (2013.01)

(58) Field of Classification Search
CPC ..... A63B 53/02; A63B 53/04; A63B 53/0466; A63B 53/047; A63B 53/0475; A63B 53/0487
USPC ..... 473/324–350
See application file for complete search history.

(56) References Cited

U.S. PATENT DOCUMENTS

| | | | | |
|---|---|---|---|---|
| 7,059,973 | B2 * | 6/2006 | Erickson | A63B 60/00 473/345 |
| 8,016,691 | B2 * | 9/2011 | Stites | A63B 53/0466 473/290 |
| 8,038,546 | B2 * | 10/2011 | Yokota | A63B 53/0466 473/346 |
| 8,172,697 | B2 * | 5/2012 | Cackett | A63B 60/52 473/329 |
| 9,033,822 | B1 * | 5/2015 | DeMille | A63B 53/04 473/345 |
| 9,662,549 | B2 * | 5/2017 | Vrska, Jr. | A63B 53/047 |
| 9,757,629 | B2 * | 9/2017 | Seluga | A63B 53/04 |
| 9,808,682 | B2 * | 11/2017 | DeMille | A63B 53/0466 |
| 9,861,866 | B2 * | 1/2018 | DeMille | A63B 53/04 |
| 10,105,579 | B1 * | 10/2018 | DeMille | A63B 60/00 |
| 10,420,993 | B2 * | 9/2019 | Pergande | A63B 60/00 |
| 10,722,766 | B1 * | 7/2020 | Gonczi | A63B 53/0466 |

FOREIGN PATENT DOCUMENTS

CN 2017-37749 J * 1/2017

* cited by examiner

*Primary Examiner* — Alvin A Hunter
(74) *Attorney, Agent, or Firm* — Rebecca Hanovice; Michael Catania; Sonia Lari

(57) ABSTRACT

A golf club head comprising a body cast from a combination material comprising a titanium alloy and a graphene material is disclosed herein. The titanium alloy preferably is 6-4, and the graphene material may be graphene or graphene oxide, and may comprise 0.01-5.0% by weight of the combination metal alloy.

12 Claims, 3 Drawing Sheets

GOLF CLUB HEAD CAST FROM GRAPHENE REINFORCED TITANIUM ALLOY

CROSS REFERENCES TO RELATED APPLICATIONS

The present application claims priority to U.S. Provisional Patent Application No. 62/780,783, filed on Dec. 17, 2018, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club cast from one or more graphene reinforced titanium alloys.

Description of the Related Art

The prior art discloses various golf club heads cast from different metal materials, including metal alloys. However, there remains a need for low-cost titanium alloys with improved mechanical properties that do not require expensive, post-processing treatments such as complicated heat treatments.

BRIEF SUMMARY OF THE INVENTION

One aspect of the present invention is a metal alloy material comprising titanium and approximately 0.01-5.0% graphene material by weight, wherein the graphene material is selected from the group consisting of graphene and graphene oxide.

Another aspect of the present invention is a golf club head comprising a body with a striking face section, a sole section, and a top section, the body defining a hollow interior, wherein the body is composed of a combination material comprising titanium alloy and a graphene material, and wherein the graphene material is selected from the group consisting of graphene and graphene oxide. In some embodiments, the graphene material may comprise 0.01-5.0% by weight of the combination material. In other embodiments, the titanium alloy may be 6-4 titanium alloy.

Yet another aspect of the present invention is a golf club head comprising a body comprising a striking face section, a bottom section, and a top section, the body defining a hollow interior, and a plurality of stiffening members, each of the plurality of stiffening members extending from the top section to the bottom section, wherein the striking face section comprises a face center and a rear face surface facing the hollow interior, wherein the first stiffening member is located no more than 0.25 inch away from the face center along a horizontal axis extending parallel to the striking face section, and wherein the body is composed of a combination material comprising 6-4 titanium alloy and no more than 5% of a graphene material by weight. In some embodiments, the graphene material may be selected from the group consisting of graphene and graphene oxide. In other embodiments, at least one of the plurality of stiffening members may be a solid rod. In yet another embodiment, each of the plurality of stiffening members may be located less than 0.500 inch from the rear face surface along a vertical plane extending through the face center perpendicular to the striking face section. In any of these embodiments, the body may have a volume ranging from 200 cubic centimeters to 475 cubic centimeters.

Another aspect of the present invention is a golf club head comprising a body comprising a striking face section, a bottom section, and a return section, the body defining a hollow interior, and first and second stiffening members extending from the return section to the bottom section, wherein the striking face section comprises a face center and a rear face surface facing the hollow interior, wherein the each of the first and second stiffening members is located no more than 0.25 inch away from the face center along a horizontal axis extending parallel to the striking face section, wherein each of the first and second stiffening members is located less than 0.500 inch from the rear face surface along a vertical plane extending through the face center perpendicular to the striking face section, wherein the body is composed of a combination material comprising 6-4 titanium alloy and no more than 5% of a graphene material by weight, and wherein the graphene material is selected from the group consisting of graphene and graphene oxide.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
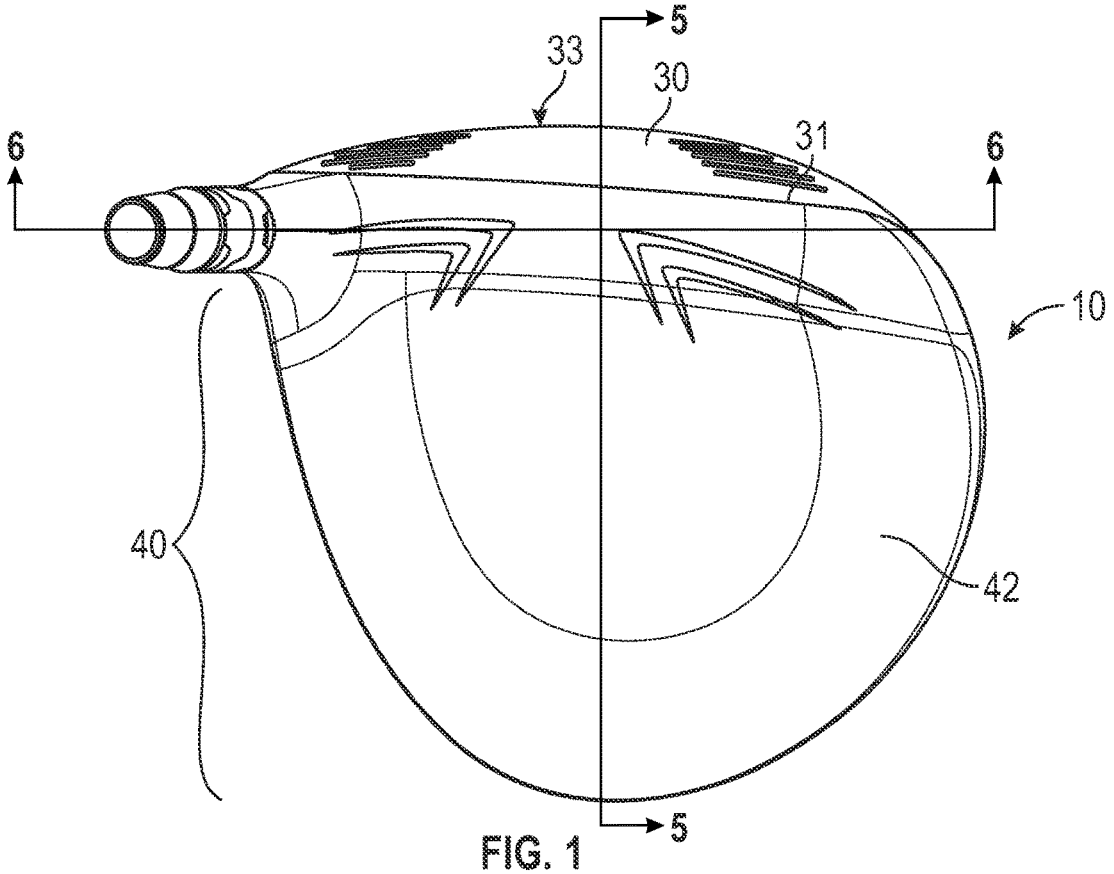
FIG. 1 is a top plan view of a first embodiment of the golf club head of the present invention.
Figure 2:
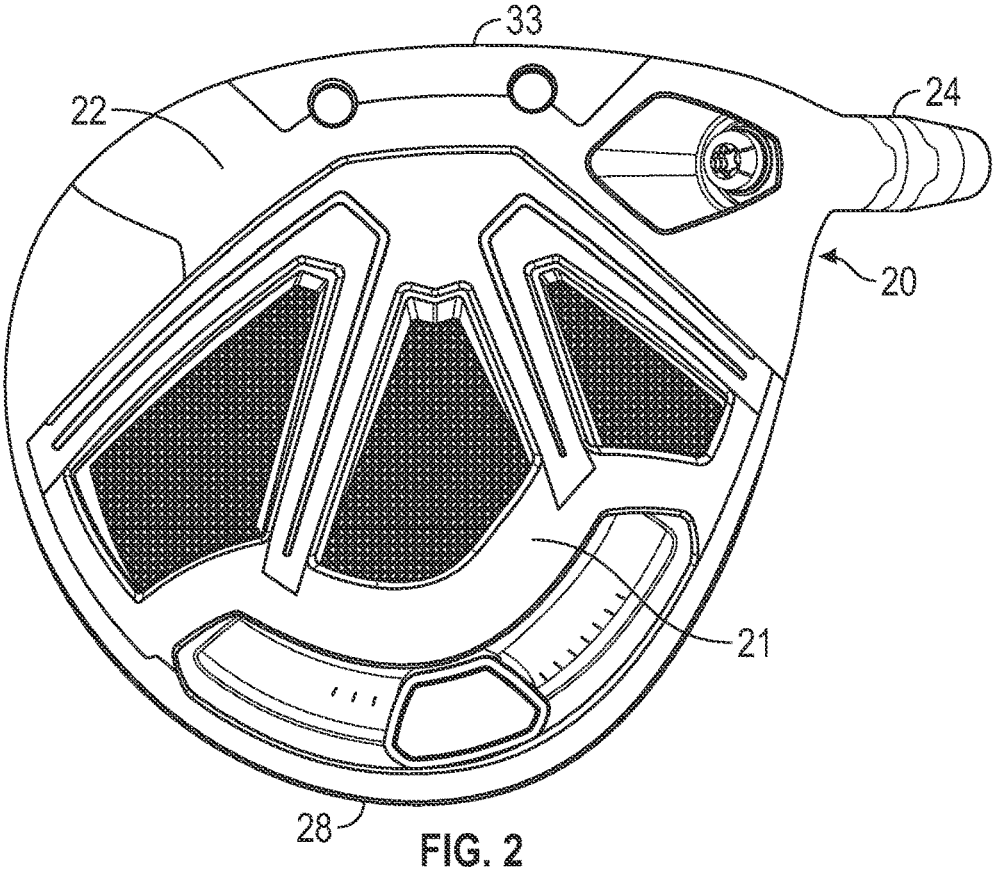
FIG. 2 is a sole plan view of the golf club head shown in FIG. 1.
Figure 3:
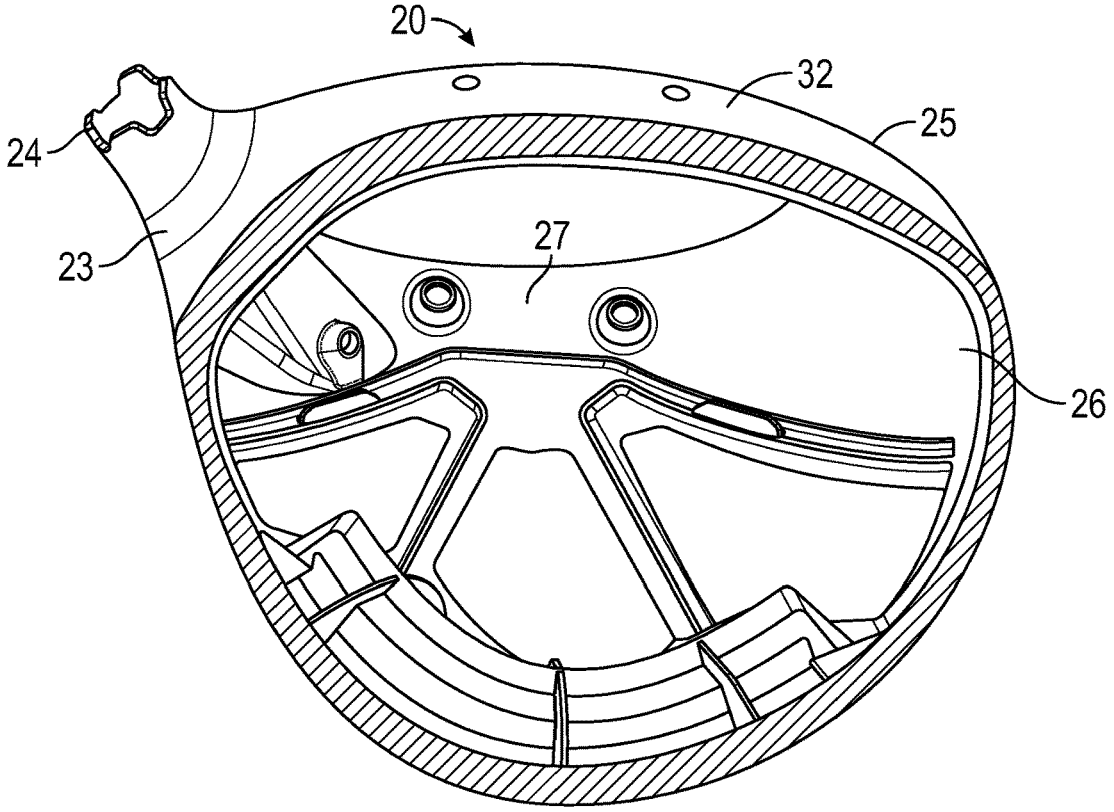
FIG. 3 is a top perspective view of the golf club head shown in FIG. 1 with the crown section removed to illustrate an interior.
Figure 4:
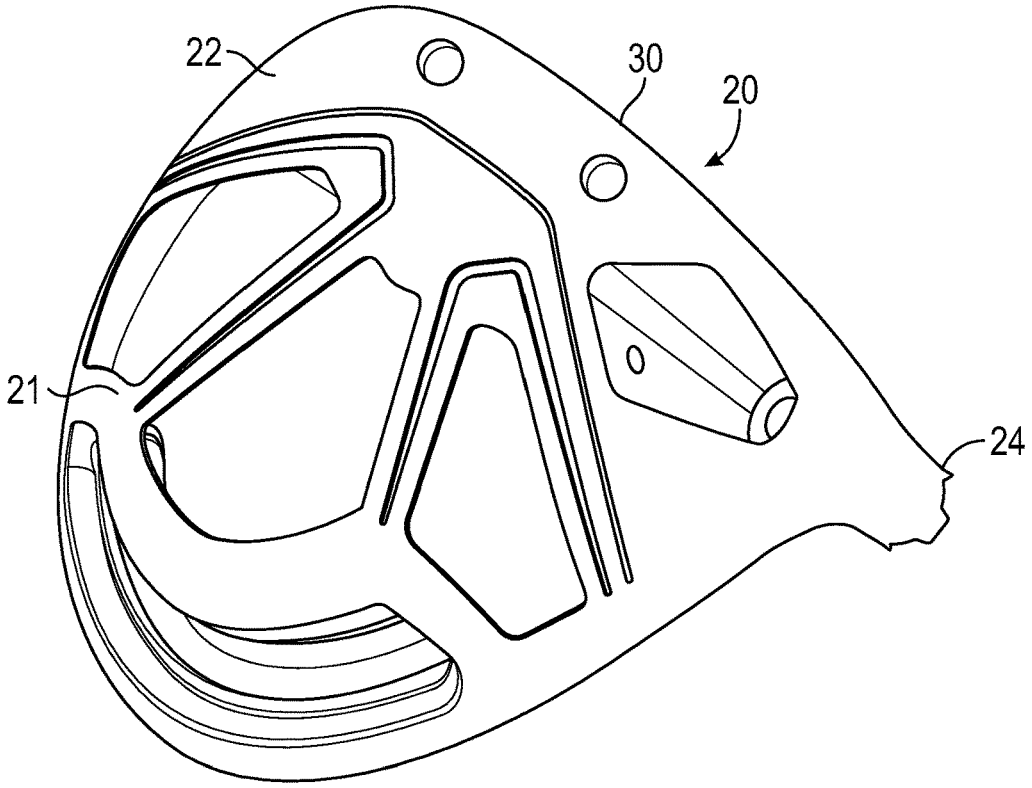
FIG. 4 is a sole perspective view of the embodiment shown in FIG. 3.
Figure 5:
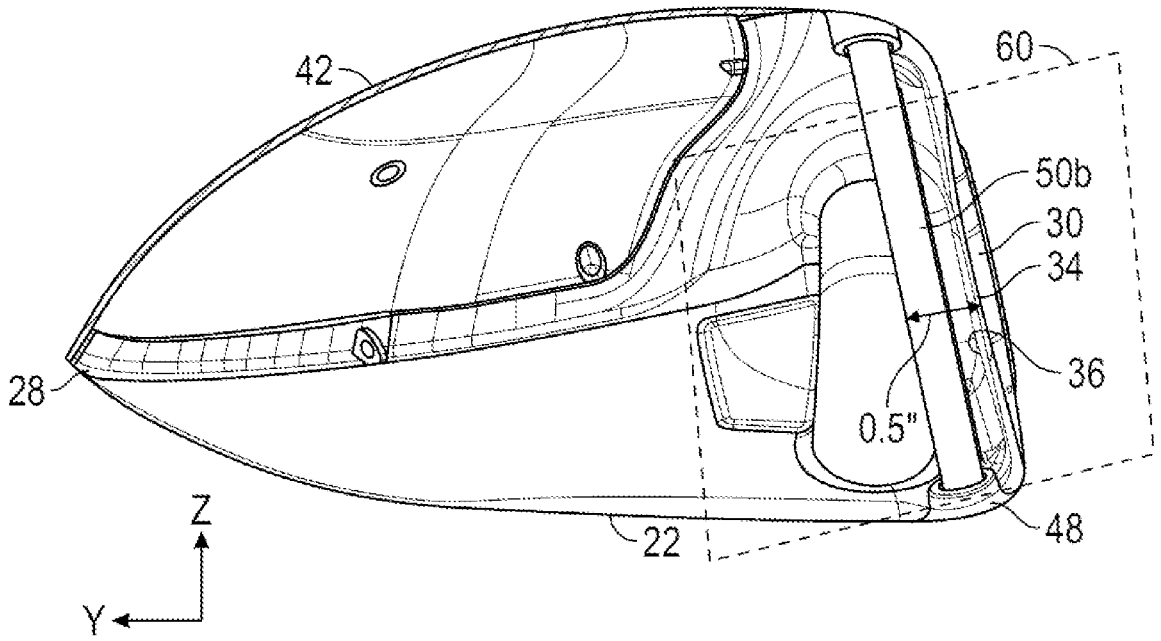
FIG. 5 is a cross-sectional view of the embodiment shown in FIG. 1 along lines 5-5.
Figure 6:
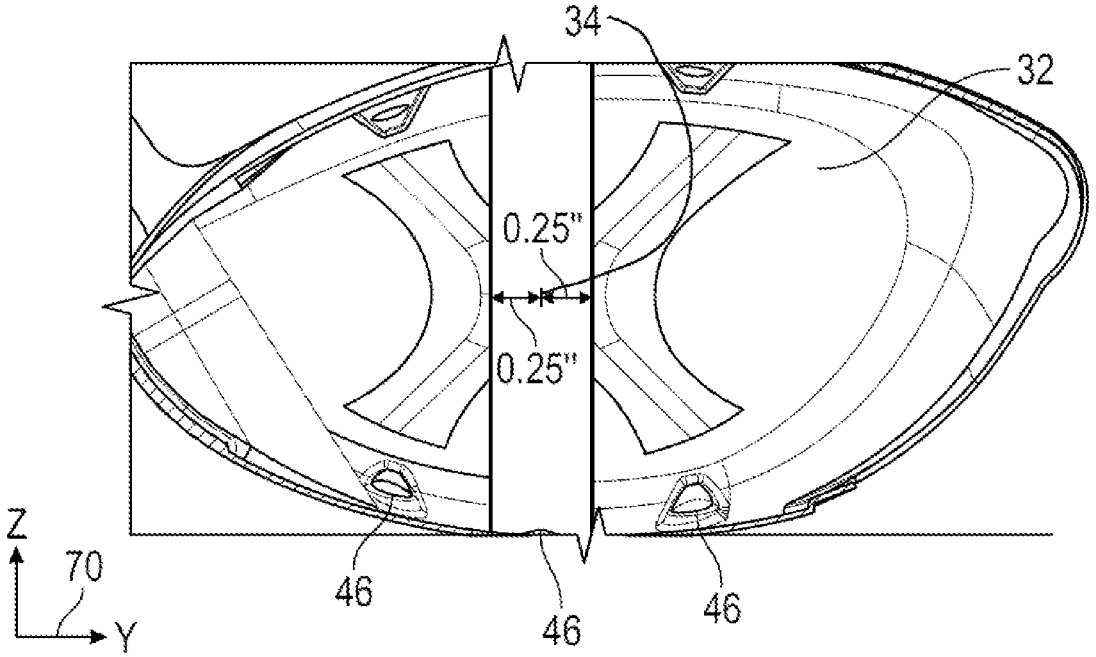
FIG. 6 is a cross-sectional view of the embodiment shown in FIG. 1 along lines 6-6.

As shown in FIGS. 1-6, a preferred embodiment of the golf club head 10 of the present invention is generally designated. The golf club head 10 includes a body 20 having a sole section 22, a striking face section 30, a return section 32 extending away from an upper edge of the striking face section 30, a hosel 24 for engaging a shaft, a heel end 23, a toe end 25, an upper opening 26, a hollow interior 27, and an aft end 28. A crown section 40 is comprised of the return section 32 and a crown insert 42 that is placed over the upper opening 26 to enclose the hollow interior 27. Within the hollow interior 27, multiple stiffening members 50 extend from the sole section 22 upward to the return section 32. The structure and composition of these stiffening members 50 may be selected from any of the embodiments disclosed in U.S. Pat. Nos. 9,486,677, 9,597,558, 9,597,561, 9,687,701, 9,687,702, 9,694,257, 9,757,629, 9,776,058, 9,814,947, 9,821,199, 9,827,469, 9,855,476, 9,889,349, 9,908,016, 9,908,017, 9,931,549, 9,931,550, 9,968,834, 9,981,167, 9,987,527, 10,010,771, and 10,065,085, the disclosure of each of which is hereby incorporated by reference in its entirety herein.

The body 20 of the golf club head 10 disclosed herein is composed of a titanium alloy that comprises graphene. Graphene is a two-dimensional, single atom-thick, carbon layer, hexagonal lattice, with a tensile strength that is one hundred and fifty times that of steel. It has an elongation of one hundred and twenty percent, and can carry a thousand times more electricity than copper. Graphene may improve the mechanical properties of the titanium alloy from which the golf club body 20 is cast, particularly tensile strength, yield strength, and elongation. In the preferred embodiment, the body 20 is cast from a 6-4 titanium alloy with a graphene or graphene oxide loading of 0.01-5.0% by weight. The graphene is dispersed into the titanium alloy by being added to the casting crucible directly, or by being packaged with other alloying elements or revert. The melt is then agitated via the inductive force of the furnace, and the material is cast at a temperature of 1600-2500° C.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a striking face section, a sole section, and a top section, the body defining a hollow interior, wherein the body is cast from a combination material comprising titanium alloy and a graphene material, wherein the graphene material comprises no more than 2.0% by weight of the combination material, and wherein the graphene material is selected from the group consisting of graphene and graphene oxide.

2. The golf club head of claim 1, wherein the titanium alloy is 6-4 titanium alloy.

3. The golf club head of claim 1, wherein the graphene material is 0.05 to 0.5% weight of the combination material.

4. A golf club head comprising:

a body comprising a striking face section, a bottom section, and a top section, the body defining a hollow interior; and a plurality of stiffening members, each of the plurality of stiffening members extending from the top section to the bottom section, wherein the striking face section comprises a face center and a rear face surface facing the hollow interior, wherein each stiffening member of the plurality of stiffening members is located no more than 0.25 inch away from the face center along a horizontal axis extending parallel to the striking face section, and wherein the body is cast from a combination material comprising 6-4 titanium alloy and no more than 2% of a graphene material by weight.

5. The golf club head of claim 4, wherein the graphene material is selected from the group consisting of graphene and graphene oxide.

6. The golf club head of claim 4, wherein at least one of the plurality of stiffening members is a solid rod.

7. The golf club head of claim 4, wherein each of the plurality of stiffening members is located less than 0.500 inch from the rear face surface along a vertical plane extending through the face center perpendicular to the striking face section.

8. The golf club head of claim 4, wherein the body has a volume ranging from 200 cubic centimeters to 475 cubic centimeters.

9. The golf club head of claim 4, wherein the graphene material is 0.05 to 0.5% by weight of the combination material.

10. A golf club head comprising:

a body comprising a striking face section, a bottom section, and a return section, the body defining a hollow interior; and first and second stiffening members extending from the return section to the bottom section, wherein the striking face section comprises a face center and a rear face surface facing the hollow interior, wherein the each of the first and second stiffening members is located no more than 0.25 inch away from the face center along a horizontal axis extending parallel to the striking face section, wherein each of the first and second stiffening members is located less than 0.500 inch from the rear face surface along a vertical plane extending through the face center perpendicular to the striking face section, wherein the body is cast from a combination material comprising 6-4 titanium alloy and no more than 2% of a graphene material by weight, and wherein the graphene material is selected from the group consisting of graphene and graphene oxide.

11. The golf club head of claim 10, wherein the golf club head is a driver-type head.

12. The golf club head of claim 10, wherein the graphene material is 0.05 to 0.5% by weight of the combination material.

* * * * *